US006314923B1

(12) United States Patent
Tompkins

(10) Patent No.: US 6,314,923 B1
(45) Date of Patent: Nov. 13, 2001

(54) OPPOSED SUPERCHARGED TWO-STROKE ENGINE MODULE WITH CROSSFLOW TRANSFER

(75) Inventor: Robert Frederick Tompkins, Cardiff (GB)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/769,061

(22) Filed: Jan. 25, 2001

(51) Int. Cl.[7] ..... F02B 59/00
(52) U.S. Cl. ..... 123/42; 123/47 AB
(58) Field of Search ..... 123/42, 47 R, 123/47 AB, 50 R

(56) References Cited

U.S. PATENT DOCUMENTS

| | | | |
|---|---|---|---|
| 1,278,571 | 9/1918 | Bell . | |
| 1,437,928 | 12/1922 | Brockway . | |
| 2,786,458 | 3/1957 | Luttrell . | |
| 4,178,885 | 12/1979 | Konther et al. . | |
| 4,331,108 | 5/1982 | Collins . | |
| 4,425,880 | 1/1984 | Rochlus . | |
| 5,490,482 * | 2/1996 | Genet | 123/47 R |
| 5,692,462 * | 12/1997 | Hackett | 123/42 |

* cited by examiner

*Primary Examiner*—Marguerite McMahon
(74) *Attorney, Agent, or Firm*—Carlos Hanze

(57) ABSTRACT

A two-stroke internal combustion engine 7 is provided. The engine 7 has a first piston 12 with a head 16 and a second piston 28 with a head 30 which faces the first piston 12. First and second pistons 12, 28 have valved exhaust lines 20 intersecting with the piston heads 16, 30. A sleeve 32 encircles the first piston 12. The sleeve 32 has a closed end 36 forming a first intake space 40. A second sleeve 44 encircles the second piston 28 and has a closed end 50 forming a second intake space 54. Check valves 56 are provided for allowing flow of air into the intake spaces 40, 54. A cylinder 60 is slidably mounted on the pistons 12, 28 for reciprocal movement thereon. The cylinder 60 is H-shaped having an internal pressure boundary 64 forming separate combustion chambers 70, 72 with the pistons 12, 28. The cylinder 60 has ends 76, 86 sealed with the pistons 12, 28 and the sleeves 32, 44 forming a variable volume induction/compression area in the intake spaces 40, 54. The cylinder 60 has passages 90, 94 connecting the intake spaces 40, 54 with the combustion chambers 70, 72 when the cylinder 60 is moved adjacent extreme positions towards the pistons 12, 28.

18 Claims, 4 Drawing Sheets

OPPOSED SUPERCHARGED TWO-STROKE ENGINE MODULE WITH CROSSFLOW TRANSFER

FIELD OF THE INVENTION

The field of the present invention is internal combustion engines. More particularly, the present invention relates to internal combustion engines that can be operated as two-stroke engines suitable for automotive use.

BACKGROUND OF THE INVENTION

In the most recent quarter century, there has been a major effort to increase fuel economy of automotive vehicles. To achieve an increase in fuel economy, several technical trends have developed. One technical trend is a change from rear wheel drive to front wheel drive vehicles. Front wheel drive vehicles tend to increase fuel economy by placing the weight of the engine over the traction wheels of the vehicle. Another technical trend is to diminish the vehicle's aerodynamic drag. To lower the aerodynamic drag, the hood region of many vehicles has been lowered. The front end of the vehicle is more round or pointed instead of the box front end which was common on many prior vehicles. Additionally, the grill area is typically smaller.

The use of two-stroke cycle internal combustion engines has been proposed to significantly reduce vehicle weight and to further reduce aerodynamic drag by further lowering the hood. Conventional two-stroke internal combustion engines have a very high power-to-weight ratio. Accordingly, use of a two-stroke engine would reduce the overall vehicle weight. Moreover, two-stroke engines have a very high power-to-space ratio as compared with the conventional four stroke engines. Accordingly, the use of two-stroke engines would allow for further lowering of the front hood to further reduce the aerodynamic drag of a vehicle.

Conventional two-stroke engines have been limited in their applications by issues with symmetrical port opening control times and, as a result, short circuit scavenging. To reduce the port opening control time, scavenging pumps are employed to overcome the limitations of scavenging at gage pressure. Limitations in available economic sealing methods effectively limit pump pressure and therefore the volumetric efficiency of the engine. Thermo-efficiency is also limited by the need to keep incoming air dense (cool).

It is desirable to provide a two-stroke internal combustion engine which provides a high scavenge pressure that delivers high density air and also reduces the port opening time.

SUMMARY OF THE INVENTION

To make manifest the above delineated and other manifold desires, the revelation of the present invention is brought forth. In a preferred embodiment, the present invention brings forth a supercharged two-stroke internal combustion engine that has ignition and exhaust valve timing which can be selectively varied independent of the compression stroke of the engine. In a preferred embodiment, the present invention provides a first piston with a head. The first piston has a valved exhaust line intersecting with the first piston head. A second piston fixed with respect to the first piston is provided with a head facing the first piston. The first and second pistons are positionally fixed to a common axis of the vehicle. In like manner, the second piston has a valved exhaust line intersecting with the second piston head. A first sleeve is provided which encircles the first piston. The first sleeve has a closed end generally opposite the first piston head forming a first air intake space with the first piston. A second sleeve is provided which encircles the second piston. In a similar manner, the second piston has a closed end generally opposite the second piston head. The second sleeve forms a second air intake space with the second piston. First and second check valves are respectively provided for allowing flow of air into the first and second intake spaces.

A cylinder is provided which is slidably mounted on the first and second pistons for reciprocal movement thereon. The cylinder is H-shaped having an internal pressure boundary forming a first combustion chamber with the first piston and a second combustion chamber with the second piston. The cylinder has a first peripheral end sealed with the first piston and the first sleeve forming a variable volume induction/compression area in the first intake space. The cylinder also has a second peripheral end, which is sealed with the second piston and with the second sleeve, forming a second variable volume induction/compression area in the second intake space.

The cylinder has a first passage connecting the first intake space with the second combustion chamber when the cylinder is moved adjacent an extreme position towards the first piston to deliver a charge of compressed air to the second combustion chamber. The cylinder has a second passage connecting the second intake space with the first combustion chamber when the cylinder is moved adjacent an extreme position with respect to the second piston to deliver compressed air to the first combustion chamber. In operation, the air fuel mixture within the first combustion chamber is ignited. The cylinder is translated from a position adjacent to the head of the first piston in a direction towards the second piston. The movement of the cylinder towards the second piston causes air to be induced within the first intake space. Simultaneously, air within the second intake space is compressed, as is the charge, which is currently in the second combustion chamber. Exhaust gases from the first combustion chamber are thereafter removed through a valved line in the first piston. Contemporaneously, the charge, which is compressed in the second intake space has transferred via a passage in the cylinder to the first combustion chamber. After being fully compressed, the second combustion chamber is ignited to transfer the cylinder back towards the first piston. Air is induced into the second intake space by the movement of the cylinder. Simultaneously, entrapped air in the first intake space is compressed as is the charge within the first compression area. With the cylinder reaching a point adjacent an extreme position towards the first piston, the exhaust of the second combustion chamber is valved through the second piston. Contemporaneously, a compressed charge is delivered through a separate passage from the first intake space to the second combustion chamber. Thereafter, the charge within the first combustion chamber is fully compressed and the charge is ignited reversing the cylinder and starting a new cycle. In the preferred embodiment, power is delivered from the cylinder via an eccentric connection with a crankshaft. Alternate technology may include electromatic induction and/or pumping a coupling fluid media.

The internal combustion engine of the present invention provides supercharging with a high scavenge pressure which delivers high density air. Port opening time is significantly reduced. Transfer port opening time is also minimized which increases the volumetric efficiency. In a preferred embodiment, the cylinder can be annular in shape so that it may benefit from utilizing existing piston ring sealing technology and formed components. The exhaust valve venting through the fixed pistons enables the possibility of scavenging heat from the exhaust gas during the supercharging process which provides additional thermo-dynamic benefits.

It is a feature of the present invention to provide a two-stroke internal combustion engine wherein the exhaust is valved through the pistons.

Other features of the invention will become more apparent to those skilled in the art upon a reading of the following detailed description and reference to the drawings.

DETAILED DESCRIPTION OF THE INVENTION

Figure 1:
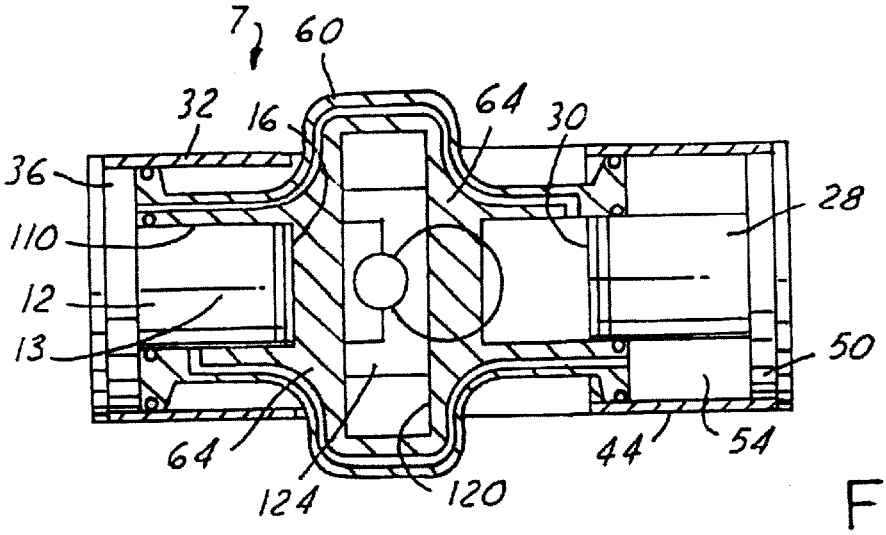
FIG. 1 is a sectional view of an internal combustion engine according to the present invention.
Figure 7:
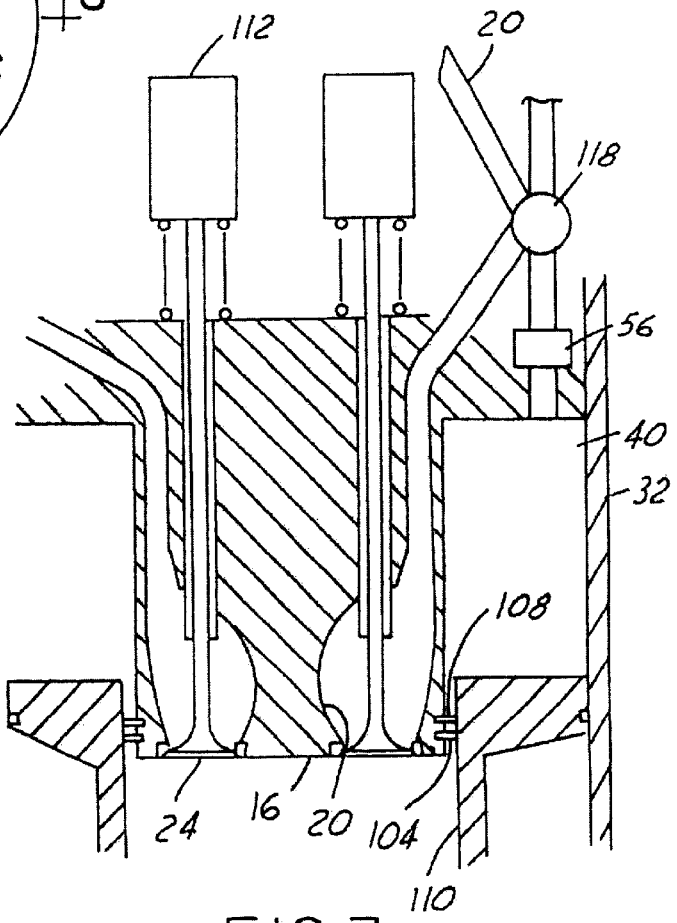
FIGS. 7 and 8 are views taken along lines 7—7 and 8—8 of FIG. 6 respectively.

FIG. 1 illustrates an internal combustion engine 7 according to the present invention. Referring additionally to FIGS. 2–8, the engine 7 has a first piston 12. The first piston 12 is fixed with respect to the major or transverse axis 13 of the vehicle. The first piston 12 has a head 16. The head 16 is intersected by two exhaust lines 20 (FIG. 7). The exhaust lines 20 are flow controlled by poppet valves 24. Fixed with respect to the first piston 12, is a second piston 28. The second piston 28 has a head 30 which faces the head 16 of the first piston 12.

Encircling the first piston 12 is a first sleeve 32. The first sleeve 32 has a closed end 36 generally opposite the first piston head 16. The first sleeve 32 forms a first intake space 40 between itself and the first piston 12. In a similar manner, a second sleeve 44 encircles the second piston 28 and has a closed end 50. The second sleeve 44 forms a second intake space 54 between itself and second piston 28.

The first intake space 40 has connected thereto a check valve 56 which allows the flow of air into the first intake space 40. However, check valve 56 does not allow the flow of air from the first intake space 40 back to the ambient. In a similar or identical manner, a check valve (not shown) is provided to allow for the flow of air into the second intake space 54.

The internal combustion engine 7 also has a generally Hshaped cylinder 60. The cylinder 60 is slidably mounted on first and second pistons 12, 28. The cylinder 60 has reciprocal movement upon the first and second pistons 12, 28. The cylinder 60 has an internal wall or pressure boundary 64. The pressure boundary 64 forms a first combustion chamber 70 with the first piston 12 and forms a second combustion chamber 72 with the second piston 28. The cylinder 60 has a first peripheral annular end 76. The first peripheral end 76 has an inner diameter 78 which is sealed with the side of the first piston 12. The first peripheral end 76 also has an outer diameter 82 which is sealed with the first sleeve 32. The first peripheral end 76 accordingly forms a variable volume induction/compression area in the first intake space 40. In a similar manner, the cylinder 60 has a second peripheral end 86 which is sealed with the second piston 28 and the second sleeve 44 to form a variable volume induction/compression area in the second intake space 54.

The cylinder 60 has a first passage 90. The first passage 90 connects the first intake space 40 with the second combustion chamber 72 when the cylinder 60 is moved adjacent an extreme position towards the first piston 12. Separate and distinct from the first passage 90 is a second passage 94. The second passage 94 connects the second intake space 54 with the first combustion chamber 70 when the cylinder 60 is moved adjacent an extreme position towards the second piston 28.

Figure 8:
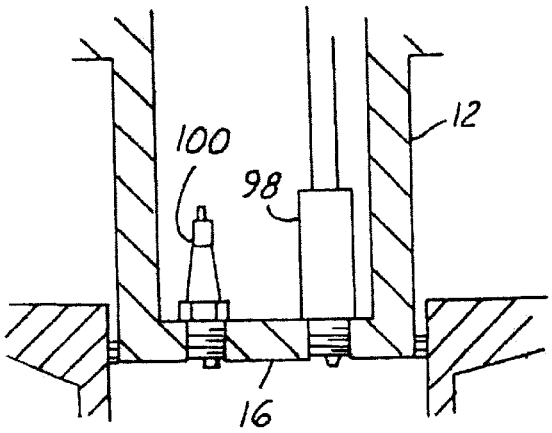

Referring to FIG. 8, the first piston head 16 has inserted therein a fuel injector 98. The first piston head 16 also has inserted therein an ignition device provided by a spark plug 100. Adjacent the first piston head 16, the piston 12 has two sealing rings 104, 108 for sealing with an inner diameter 110 of the cylinder 60.

Poppet valves 24 are provided with electromechanical or electro-hydraulic actuators 112. Poppet valves 24 can be operated jointly or independent of one another to control power output or exhaust emissions.

The cylinder 60 has a generally vertical slot 120. The vertical slot 120 has slidably mounted therein a slider member 124. Slider member 124 is eccentrically connected to a crank 128. In alternative embodiments (not shown) the drive train connection from the cylinder 60 may be via electromatic induction of and/or pumping a coupling fluid media.

Connected between the exhaust lines 20 and an inlet for the first air intake check valve 56 is an optional EGR valve 118.

Referring to FIGS. 1 and 8, the spark plug 100 will initiate combustion in the first combustion chamber 70, which will cause the cylinder 60 to be translated in a direction towards the second piston 28. Movement towards the second piston 28 will cause the first end 76 of the cylinder to induce a vacuum in the first intake space 40 causing air to flow through the first inlet check valve 56 which is provided by a controlled combination of ambient air and air from the exhaust by virtue of EGR valve 118.

Figure 2:
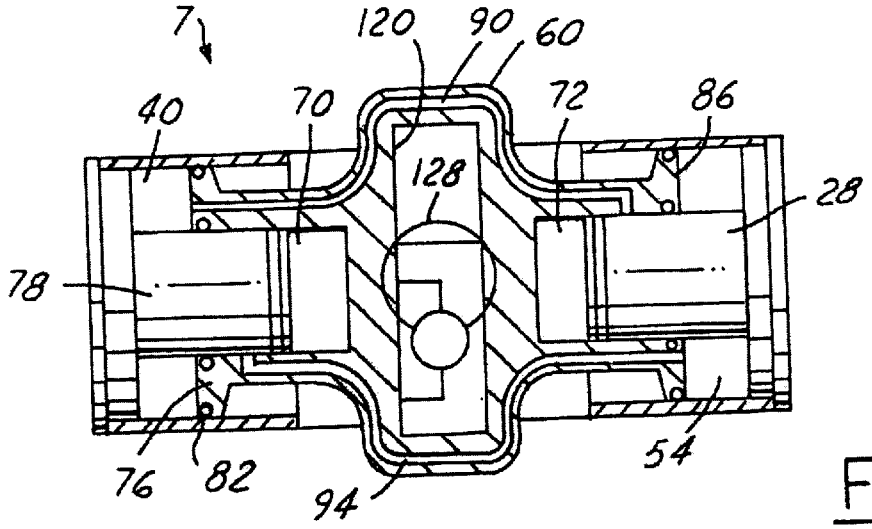
FIGS. 2–5 are views similar to FIG. 1 illustrating operation of the internal combustion engine shown in FIG. 1.

The movement of the cylinder 60 towards the second piston 28 also causes the second peripheral end 86 of the cylinder to compress the air within the second intake space 54. Simultaneously with compression of the air within the second intake space 54 will be compression of the charge within the second combustion chamber 72. The slider member 124 will be moved vertically downwards rotating the crank 128 in a counter-clockwise direction (FIG. 2).

Figure 3:
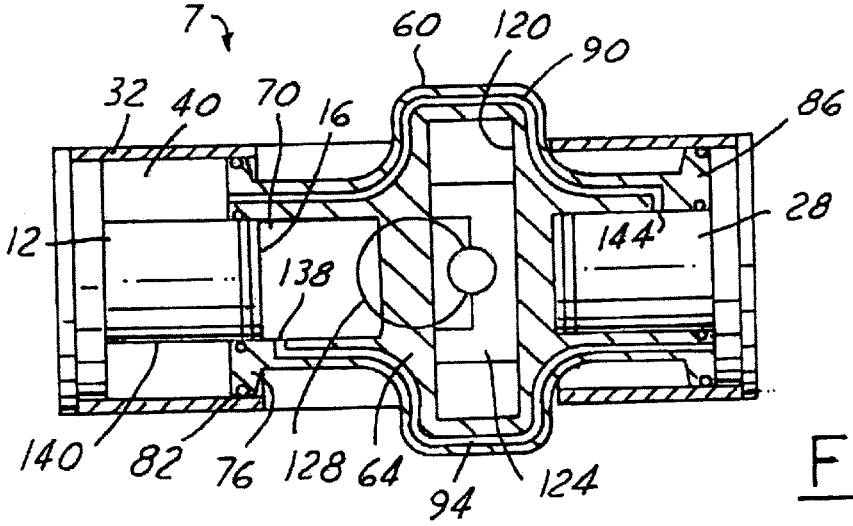

Referring to FIG. 3, the cylinder 60 has been moved adjacent an extreme position towards the second piston 28. A port 138 of the second passage 94 is now positioned clear of the cylindrical side 140 of the first piston 12. Air within the second intake space 54 is now supercharged and the resultant compressed air is delivered to the first combustion chamber 70 via the port 138 of the second passage 94. Ideally, shortly before the entry of compressed air into the first chamber 70, the actuators 112 will actuate the poppet valves 24 to allow for the release of the exhaust gas within the first combustion chamber 70 to ensure a high volumetric efficiency in the charging of the first combustion chamber by the compressed air from the second intake space 54. The charge within the second combustion chamber 72 is fully compressed and accordingly, ignition will occur. The sweep volume of the second intake space 54 will be approximately 2× the combined volume of the first combustion chamber 70 and the second passage 94. The volumetric ratios between the sweep volume of the first intake space 40 and the second combustion chamber 72 and the first passage 90 will be identical, 2×.

Figure 4:
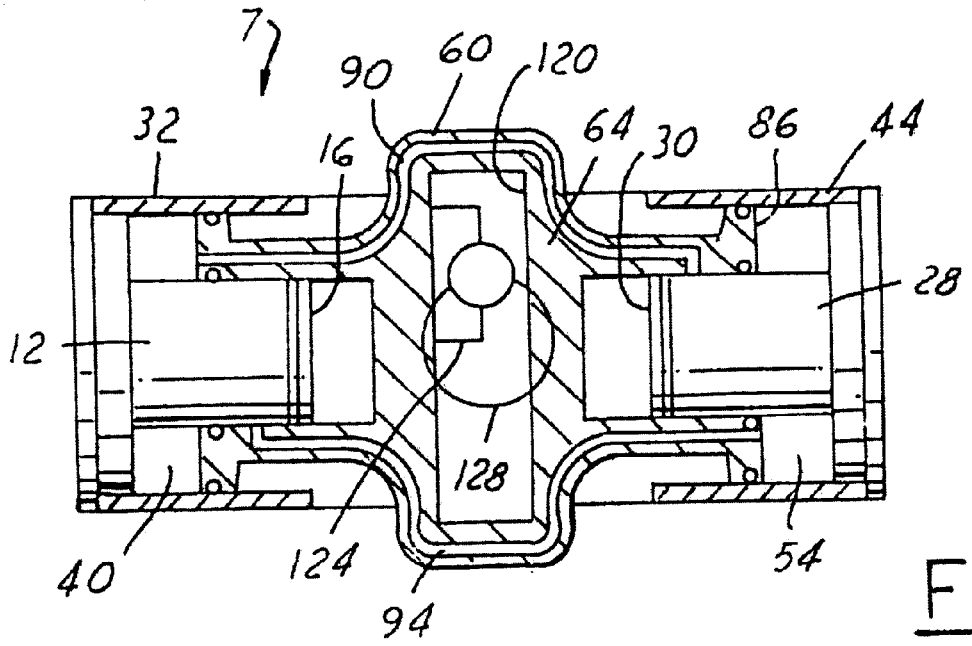

Referring to FIG. 4, the ignition in the second combustion chamber 72 now causes the cylinder 60 to be translated back towards the first piston 12. Accordingly, air is induced into the second intake space 54 through a second inlet check valve (not shown). Simultaneously, air within the first intake space 40 is compressed since it cannot escape through the first inlet check valve 56 (FIG. 7). The slider 124 is moved upward within the vertical slot 120 causing the crank 128 to further move counterclockwise. In a manner as previously described for the second combustion chamber 72, the charge within the first combustion chamber 70 is compressed.

Figure 5:
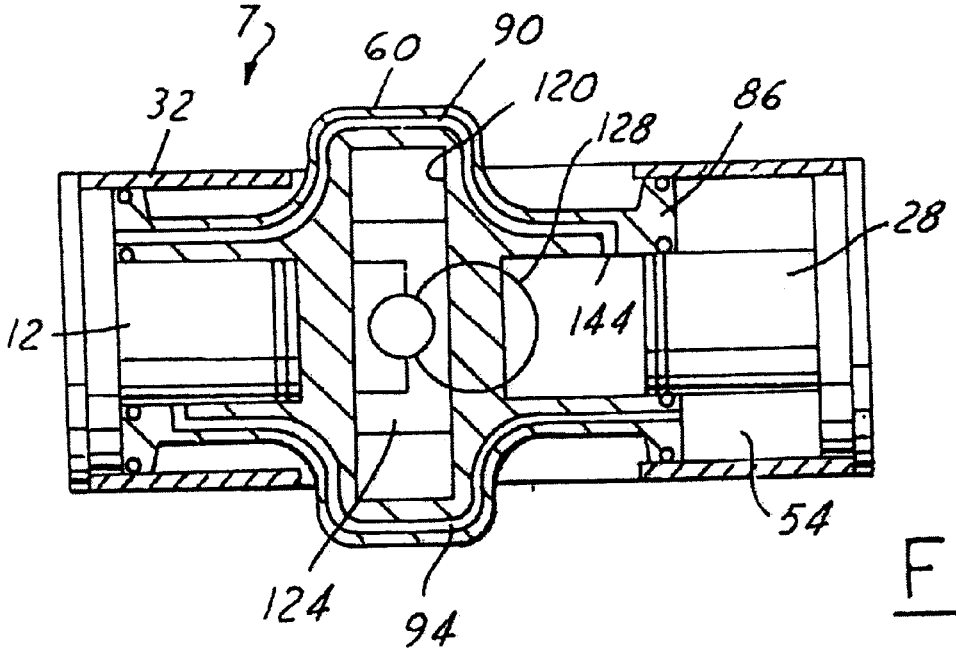
Figure 6:
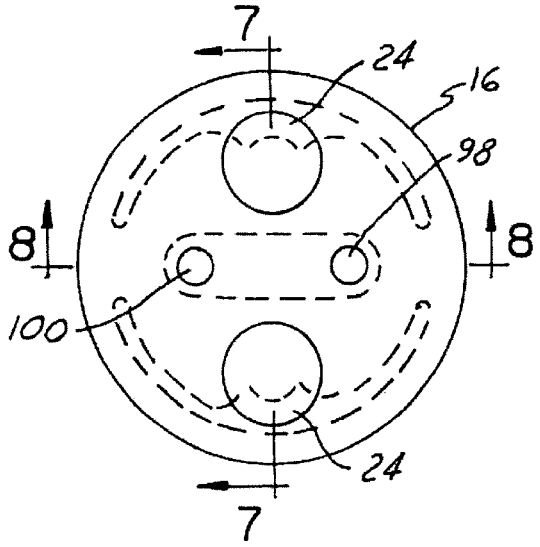
FIG. 6 is an enlarged front elevational view of a head of a piston utilized in the internal combustion engine shown in FIGS. 1–5.

Referring to FIG. 5, the cylinder 60 is now moved adjacent an extreme position towards the first piston 12. A supercharged delivery of compressed air is made through the first passage 90 to the second combustion chamber 72. Just prior to the delivery of the charge to the second combustion chamber 72 through the port 144 of the first passage 90, the exhaust valves (not shown) for the second piston 28 will be actuated. From the position shown in FIG. 5, the internal combustion engine 7 will now continue on another cycle.

The internal combustion engine 7 provides a high scavenge pressure which delivers high density air to the combustion chambers.

Due to the supercharging pressure, the amount of time that the ports 138, 144 must be exposed (open) to the respective combustion chambers is very small. This allows for very high volumetric efficiencies as compared with prior two-stroke engines. The piston sealing rings 104, 108 and the rings which seal the cylinder outer diameter and inner diameter can utilize conventional gas sealing technology circumferential ring seals. The operation of the poppet valves 24 can be selectively varied independent of the position of the cylinder 60 for reasons related to performance or emissions. In like manner, the injector 98 can function in a manner independent of the position of the cylinder 60 due to operation or emission purposes.

An advantage of the internal combustion engine 7 of the present invention is that the air which is induced into the intake spaces 40, 54 can be preheated by the exhaust gases passing through their respective encircled pistons 12 and 28.

Exhaust gas recirculation is easily achieved due to the proximity of the air intake and exhaust gas flows. By connecting more module pairs of pistons and cylinders to crank 128, the present engine can have multiple cylinder configurations. To minimize vibration, the crank 128 is expected to contain balance weights and for multiple configurations, offset pins. Still another advantage of the present invention is that rotation of crank 128 may be set in either direction, to suit engine design requirements.

Figure 9:
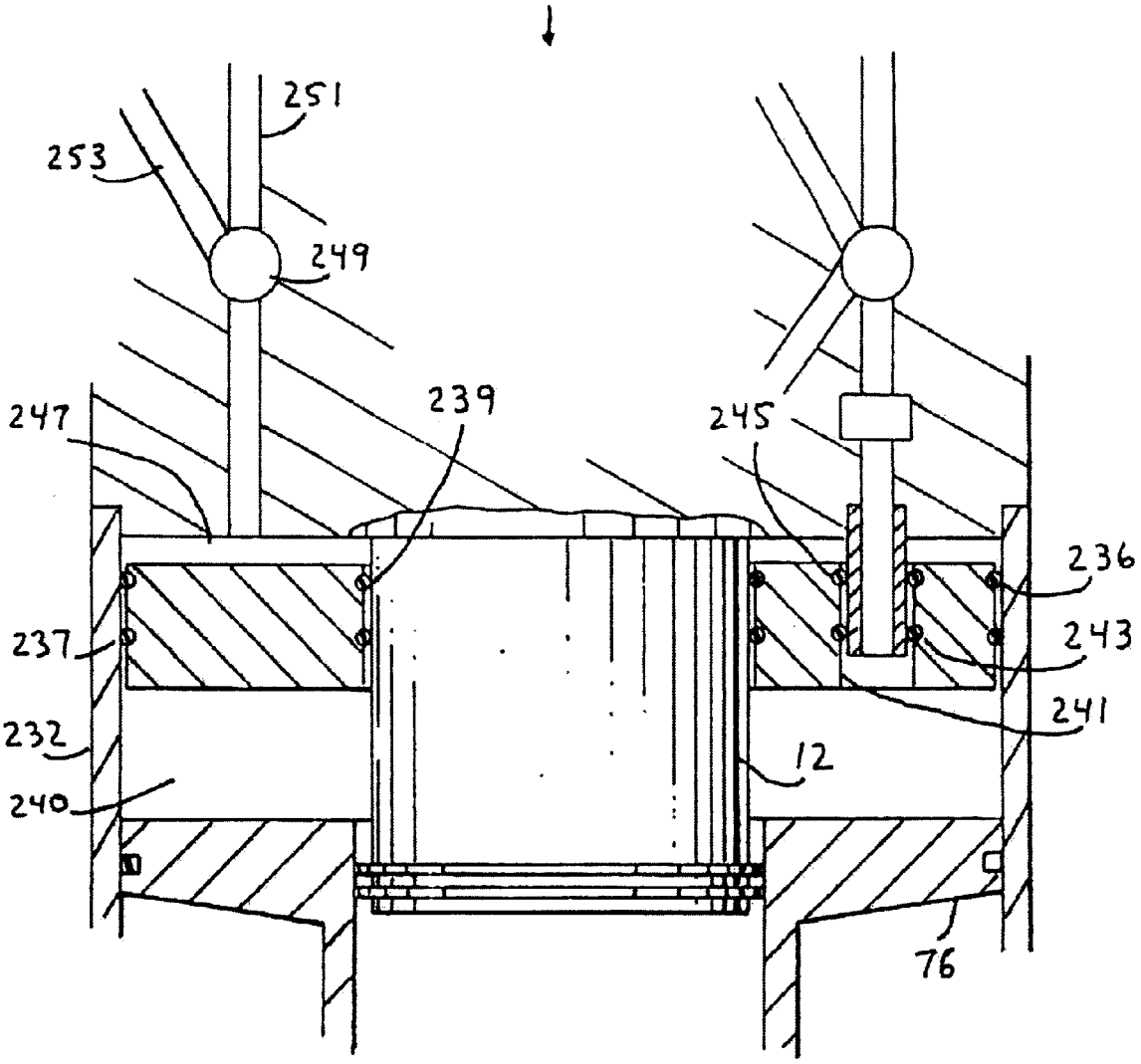
FIG. 9 is a view similar to FIG. 7 of an alternative preferred embodiment internal combustion engine of the present invention.

Referring to FIG. 9, an alternate preferred embodiment two-stroke internal combustion engine 207 is shown. Items performing similar functions are given identical reference numerals to those shown in FIGS. 7. The engine 207 has a variable volume first intake space 240. The variable volume is provided by a movable end boundary 236. The exhaust valving and routing are substantially similar or identical as that previously described and are partially removed from FIG. 9 for clarity of illustration. The end boundary 236 has axially spaced outer seals 237 to seal its outer diameter with a sleeve 232. Along its inner diameter, the end boundary 236 has a pair of similar axially spaced seals 239 to seal against the outer diameter of the piston 12. The end boundary 236 has a bore 241 which receives an inlet air tube 243. The inlet air tube 243 is sealed within the bore 241 by a pair of axially spaced seals 245. Hydraulic fluid is pumped into or from a space 247 behind the end boundary 236 by a hydraulic pump 249. Hydraulic pump 249 is provided with an inlet 251 and an exhaust 253. In operation, the end boundary 236 can be moved axially relative to the piston 12. The above movement enables the ratio of the sweep volume to be varied to compensate for variations in intake air pressure, or the effect of heating the intake charge during the induction part of the cycle wherein air is induced into the intake space 240 by movement of the first sealed end 76 of the cylinder.

While preferred embodiments of the present invention have been disclosed, it is to be understood that they have been disclosed by way of example only and that various modifications can be made without departing from the spirit and scope of the invention as it is encompassed by the following claims.

I claim:

1. An internal combustion engine comprising:

first and second pistons fixed with respect to one another with heads facing each other, each said piston having a valved exhaust line intersecting with said head of said piston;

first and second sleeves encircling said respective first and second pistons, each said sleeve having a closed end generally opposite said respective piston head, said first and second sleeves forming respective first and second intake spaces with said first and second pistons;

first and second inlet check valves for allowing flow of air into said first and second intake spaces;

a cylinder mounted on said pistons for reciprocal movement, said cylinder having an internal pressure boundary forming first and second combustion chambers with said respective first and second pistons, and said cylinder having first and second peripheral ends sealed with said respective first and second pistons and with said first and second sleeves forming first and second variable volume induction/compression areas in said first and second intake spaces, and said cylinder having first and second passages connecting said respective first and second intake spaces with said second and first combustion chambers when said cylinder is moved adjacent an extreme position toward said first and second pistons to deliver compressed air to said second and first combustion chambers.

2. An internal combustion engine as described in claim 1, wherein said engine is spark ignited.

3. An internal combustion engine as described in claim 2, wherein said engine is a two-stroke cycle engine.

4. An internal combustion engine as described in claim 1, wherein at least one of said piston heads has inserted therein an ignition device.

5. An internal combustion engine as described in claim 4, wherein said ignition device time of operation can be selectively varied with respect to a position of said cylinder on said piston heads.

6. An internal combustion engine as described in claim 1, wherein a time of operation of said exhaust valve may be selectively varied with respect to a position of said cylinder on said piston head.

7. An internal combustion engine as described in claim 1, further including an EGR valve between one of said valved exhaust lines and one of said inlet check valves.

8. An internal combustion engine as described in claim 1, wherein said air delivered to said first and second combustion chambers is supercharged.

9. An internal combustion engine as described in claim 1, wherein at least said first piston head has two exhaust valves.

10. An internal combustion engine as described in claim 1, wherein said cylinder is connected to an eccentric crank.

11. An internal combustion engine as described in claim 1, wherein said first and second pistons are positionally fixed to a common axis.

12. An internal combustion engine as described in claim 1, having at least one intake space with a selectively movable boundary.

13. A two-stroke internal combustion engine comprising:

a first piston fixed with respect to a first axis with a head, said first piston having an exhaust line intersecting with said head;

a second piston fixed with respect to said first piston and with respect to said first axis, said second piston having a head facing towards said first piston, said second piston having an exhaust line intersecting with said second piston head;

a first sleeve encircling said first piston with a closed end generally opposite said first piston head, said first sleeve forming a first intake space with said first piston;

a second sleeve encircling said second piston with a closed end generally opposite said second piston head, said second sleeve forming a second intake space with said second piston;

a first inlet check valve for allowing flow of air into said first intake space;

a second inlet check valve for allowing flow of air into said second intake space;

a cylinder connected to an eccentric crank being slidably mounted on said first and second pistons for reciprocal movement thereon, said cylinder having an internal pressure boundary forming a first combustion chamber with said first piston and a second combustion chamber with said second piston, said first and second combustion chambers being smaller than said first and second intake spaces, and said cylinder having a first peripheral end sealed with said first piston and with said first sleeve forming a first variable volume induction/compression area in said first intake space, said cylinder also having a second peripheral end sealed with said second piston and said second sleeve forming a second variable volume induction/compression area in said second intake space, and said cylinder having a first passage connecting said first intake space with said second combustion chamber when said cylinder is moved adjacent an extreme position towards said first piston to deliver compressed air to said second combustion chamber, and said cylinder having a second passage connecting said second intake space with said first combustion chamber when said cylinder is moved adjacent an extreme position toward said second piston to deliver compressed air to said first combustion chamber; and first and second ignition devices inserted into said first and second piston heads, a time operation of said ignition devices selectively variable with respect to a position of said cylinder on said pistons; and first and second exhaust valves mounted in said exhaust lines of said first and second pistons for controlling flow through said exhaust lines of said first and second pistons, a time of operation of said valves may be selectively varied with respect to a position of said cylinder on said pistons.

14. A method of operating an internal combustion engine comprising:

fixing a position of a first piston with a head with respect to a second piston with a second head facing said first piston head;

igniting a first combustion chamber adjacent said first piston head in an H-shaped cylinder slidably sealably mounted on said first and second pistons to translate said cylinder toward said second piston;

compressing contents of a second combustion chamber in said H shaped cylinder adjacent said second piston head, and inducting intake air to an area encircling said first piston by said cylinder, creating a vacuum in an area encircling said first piston;

charging inlet air for said first combustion chamber by said cylinder compressing air encircling said second piston;

exhausting air from said first combustion chamber via a valved exhaust line intersecting with said first piston head;

delivering charged air encircling said second piston to said first combustion chamber via a passage in said cylinder;

igniting said second combustion chamber to translate said cylinder towards said first piston;

compressing contents of said first combustion chamber;

inducting air encircling said second piston by said cylinder creating a vacuum in an area encircling said second piston;

charging inlet air for said second combustion chamber by said cylinder compressing air encircling said first piston;

exhausting air from said second combustion chamber via a valved exhaust line intersecting with said second piston head;

delivering charged air encircling said first piston to said second combustion chamber via another passage of said cylinder.

15. A method as described in claim 14, wherein said ignition is initiated by an ignition device.

16. A method of operating an internal combustion engine as described in claim 15, wherein said internal combustion engine is operated as a two-stroke cycle engine.

17. A method of operating an internal combustion engine as described in claim 14, wherein the air delivered to said first and second combustion chambers is supercharged.

18. A method of operating an internal combustion engine as described in claim 17, wherein at least one of said intake spaces has a movable boundary and said boundary is moved in order to vary a compression ratio of air delivered to at least one of said combustion chambers.

* * * * *